US006848490B2

(12) United States Patent
Ho

(10) Patent No.: US 6,848,490 B2
(45) Date of Patent: Feb. 1, 2005

(54) DOUBLE-SIDED ADHESIVE TAPE DISPENSER

(76) Inventor: Hung-Chieh Ho, No. 66, Wunhua St., Jhubei City, Hsinchu County 302 (TW)

( * ) Notice: Subject to any disclaimer, the term of this patent is extended or adjusted under 35 U.S.C. 154(b) by 0 days.

(21) Appl. No.: 10/679,347

(22) Filed: Oct. 7, 2003

(65) Prior Publication Data

US 2004/0099380 A1 May 27, 2004

(30) Foreign Application Priority Data

Nov. 22, 2002 (TW) ..... 91218900 U

(51) Int. Cl.[7] ..... B32B 31/00

(52) U.S. Cl. ..... 156/527; 156/523; 156/577; 156/579; 225/56; 225/77

(58) Field of Search ..... 156/577, 579, 156/574, 576, 527, 523; 225/19, 23, 56, 77, 46, 91, 89

(56) References Cited

U.S. PATENT DOCUMENTS

| | | | | | |
|---|---|---|---|---|---|
| 3,709,760 | A | * | 1/1973 | Knoner | 156/527 |
| 4,582,558 | A | * | 4/1986 | Antonson | 156/523 |
| 5,178,717 | A | * | 1/1993 | Rodriguez | 156/523 |
| 5,759,342 | A | * | 6/1998 | Luhman et al. | 156/577 |
| 6,296,033 | B1 | * | 10/2001 | Clements | 156/527 |

* cited by examiner

*Primary Examiner*—Chris Fiorilla
*Assistant Examiner*—Cheryl N. Hawkins
(74) *Attorney, Agent, or Firm*—Bacon & Thomas PLLC

(57) ABSTRACT

A double-sided adhesive tape dispenser. The dispenser includes a main frame for mounting a rotatable adhesive tape roll thereon, a guide roller rotatably mounted on the main frame, and a driven roller rotatably mounted on the main frame. The driven roller is parallel to the guide roller and has an outer surface contacting an outer surface of the guide roller such that the driven roller is driven to roll by the guide roller.

6 Claims, 5 Drawing Sheets

DOUBLE-SIDED ADHESIVE TAPE DISPENSER

BACKGROUND OF THE INVENTION

1. Field of the Invention

The present invention relates generally to adhesive tape dispensers, and more particularly, to a double-sided adhesive tape dispenser.

2. Description of the Related Art

Generally, there are two kinds of adhesive tapes; one is single-sided adhesive tape which one side is disposed with adhesive and the other side is glare to be easily split; the other is double-sided adhesive tape which two sides are both disposed with adhesive and an isolation film having a glare surface and covered on one of the adhesive sides to enable the tape to be easily rolled. When the user intends to use the conventional single-sided adhesive tape, the user can directly adhere the adhesive side onto a workpiece. When the user intends to use the conventional double-sided adhesive tape, the user has to adhere the adhesive side onto a workpiece and then uptear and remove the isolation film, wherein the latter action is redundant to cause low working performance.

SUMMARY OF THE INVENTION

The primary objective of the present invention is to provide a double-sided adhesive tape dispenser which can remove an isolation film together while dispensing a double-sided adhesive tape.

The foregoing objective of the present invention is attained by the double-sided adhesive tape dispenser which is composed of a main frame for mounting a rotatable adhesive tape roll, a guide roller rotatably mounted on the main frame, and a driven roller rotatably mounted on the main frame. The driven roller is parallel to the guide roller and has an outer surface contacting an outer surface of the guide roller such that the driven roller is driven to roll by the guide roller when the guide roller is rotated.

DETAILED DESCRIPTION OF THE INVENTION

Figure 1:
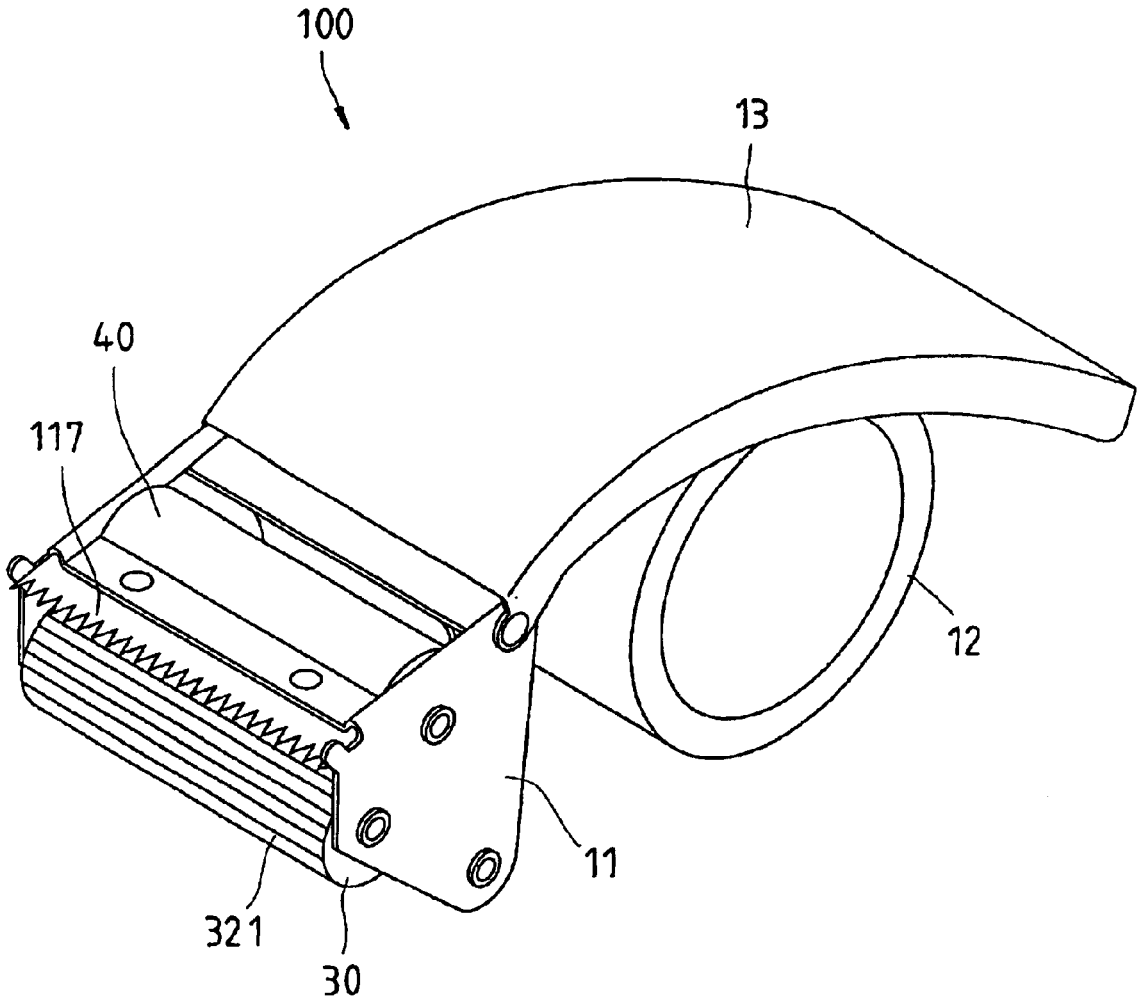
FIG. 1 is a perspective view of a preferred embodiment of the present invention.
Figure 2:
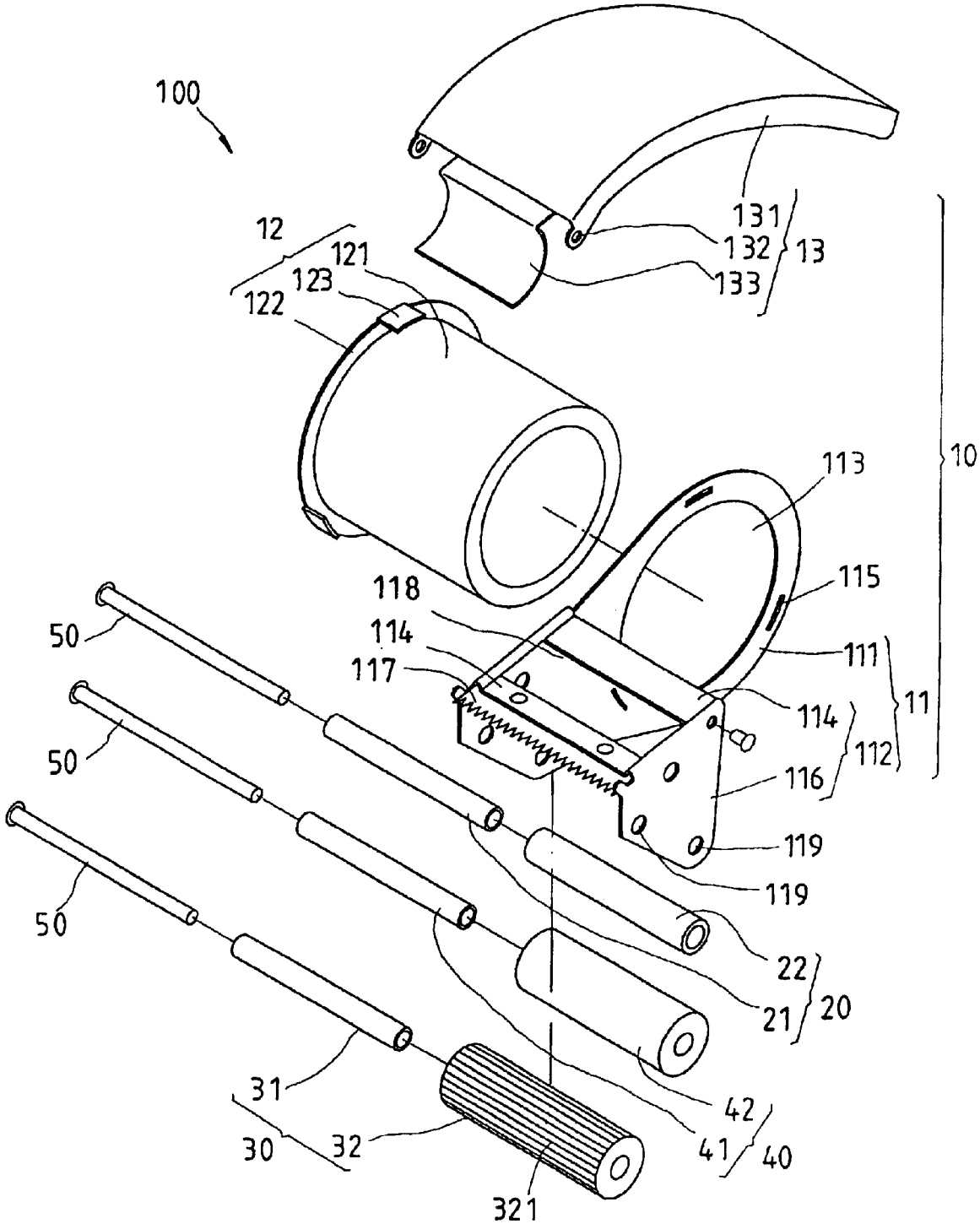
FIG. 2 is an exploded view of the preferred embodiment of the present invention.
Figure 3:
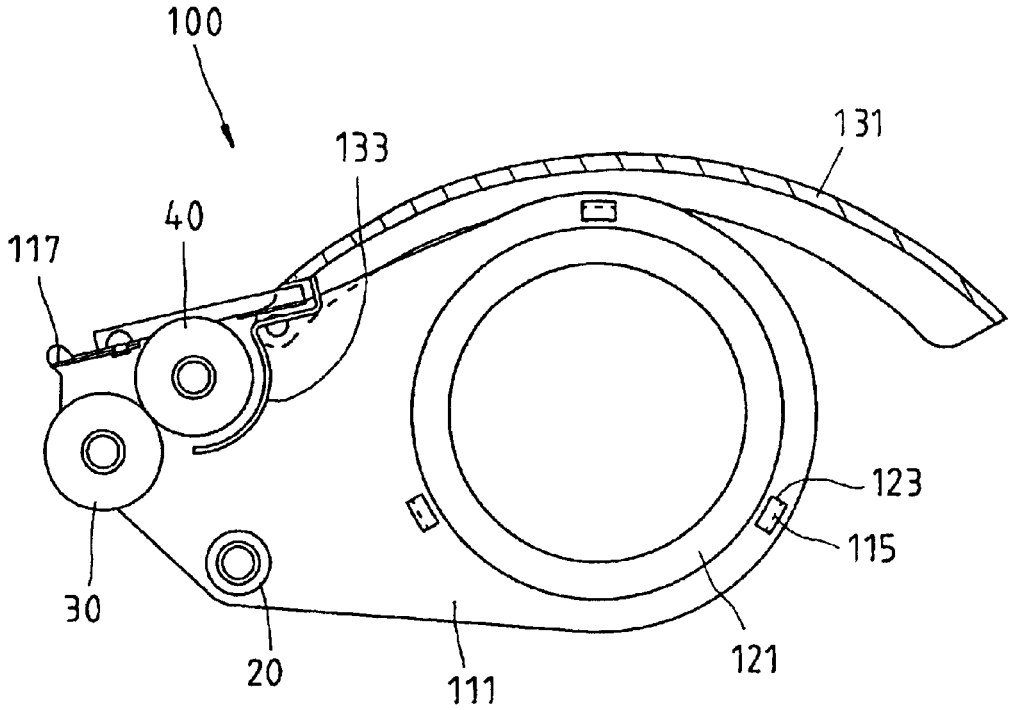
FIG. 3 is a sectional view of the preferred embodiment of the present invention.

Referring to FIGS. 1–3, a double-sided adhesive tape dispenser 100 constructed according to a preferred embodiment of the present invention is composed of a main frame 10, an auxiliary roller 20, a guide roller 30, and a driven roller 40.

The main frame 10 includes a crane 11, a reel 12, and a handle 13.

The crane 11 is composed of a first frame member 111, a second frame member 112, and a cutter 117. The first frame member 111 has a circular hole 113 formed at a rear section thereof and a plurality of clamp holes 115 formed thereon around the circular hole 113. The second frame member 112 has two top plates 114 and a guard plate 116. The two top plates 114 are spaced apart and parallel to each other, each of which is perpendicularly connected with a front top edge of the first frame member 111 at an end thereof. The guard plate 116 is perpendicularly connected with the other ends of the two top plates 114 at a lateral edge thereof. Hence, the guard plate 116 is parallel to the first frame member 111. A plurality of through holes 119 are formed on the guard plate 116 and the first frame member 111, and the through holes 119 of the guard plate 116 correspond in position to those of the first frame member 111. A slot 118 is defined among the two top plates 114, the guide plate 116, and the first frame member 111. The cutter 117 is fixed to the top plate 114 abutting a front end of the first frame member 111 and has a blade portion facing forwards (outwards).

The reel 12 includes a reel body 121 and a retaining ridge 122. The reel body 121 is a substantially hollow barrel which outer diameter is slightly smaller than the diameter of the circular hole 113. The retaining ridge 122 extends transversally outwards from an edge of an end of the reel body 121 and has a plurality of ear portions 123 in corresponding positions to the clamp holes 115. The reel body 121 is inserted into the circular hole 113 to enable the reel body 121 to engage against the first frame member 111 and the ear portions 123 to be inserted respectively into and to engage the clamp holes 115, thereby securing the reel body 121 and the first frame member 111 together.

The handle 13 has a gripping portion 131 and a guide portion 133. The gripping portion 131 is substantially an arched rectangular plate and has two pivot holes 132 formed respectively at bilateral sides of a pivot end thereof for being pivotably connected respectively with the guard plate 116 and the first frame member 111 to enable the gripping portion 131 to pivot at an angle relatively to the crane 11. The guide portion 133 is an arched rectangular sheet in contrary shape to the gripping portion 131 and connected with the pivot end of the gripping portion 131.

The auxiliary roller 20 includes an auxiliary internal roller 21 and an auxiliary external roller 22 in which the auxiliary internal roller 21 is received, and is rotatably mounted to the through holes 119 of the guard plate 116 and the first frame member 111 by a rivet 50, such that the auxiliary roller 20 can rotate between the guard plate 116 and the first frame member 111.

The guide roller 30 includes a first internal roller 31 and a first external roller 32 in which the first internal roller 31 is received, and is rotatably mounted to the through holes 119 of the guard plate 116 and the first frame member 111 by a rivet 50. The guide roller 30 is positioned above the auxiliary roller 20 and abuts a front edge of the main frame 10, such that the guide roller 30 can rotate between the guard plate 116 and the first frame member 111. The first external roller 32 has a plurality of concavoconvex indentures 321 formed on an outer surface thereof in a predetermined pattern.

The driven roller 40 includes a second internal roller 41 and a second external roller 42 in which the second internal roller 41 is received, and is rotatably mounted to the through holes 119 of the guard plate 116 and the first frame member 111 by a rivet 50. The driven roller 40 is positioned above the guide roller 30 and slightly engages against the outer surface of the first external roller 32, such that the driven roller 40 can be driven by the guide roller 30 to rotate simultaneously. In the meantime, the driven roller 40 is positioned over the guide portion 133.

Figure 4:
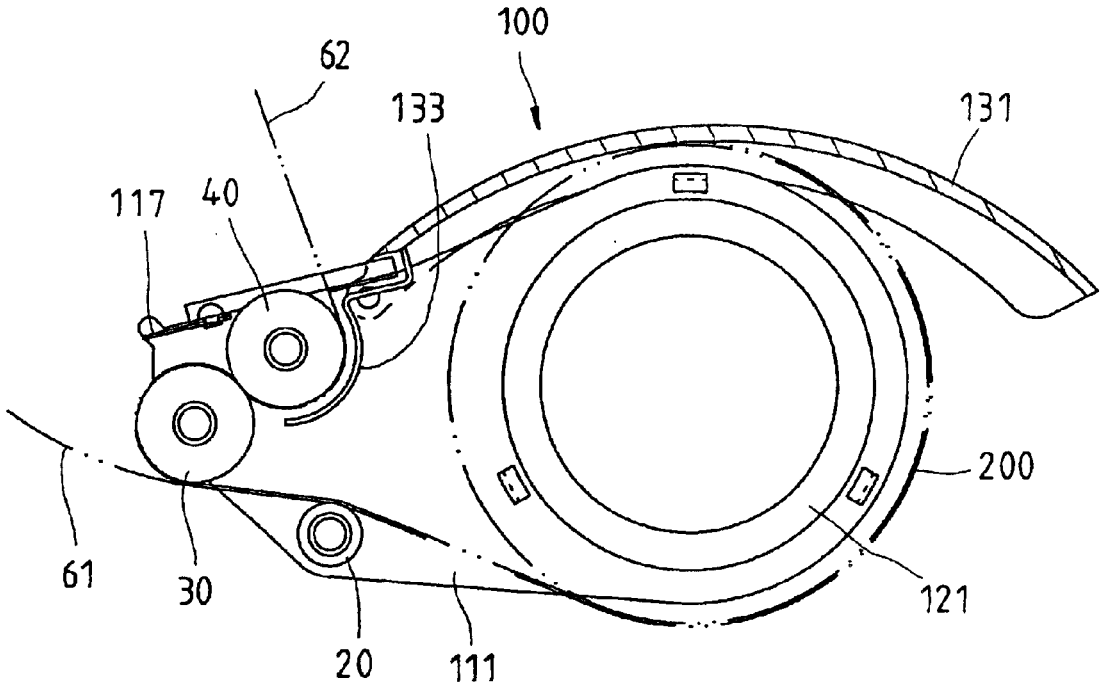
FIG. 4 is a sectional view of the preferred embodiment of the present invention mounted with a double-sided adhesive tape roll.

Referring to FIG. 4, a double-sided adhesive tape 200 which is composed of a tape body 61 having two adhesive surfaces and an isolation film 62 adhered to one adhesive surface of the tape body 61 is mounted onto the reel body 121. A free end of the tape 200 is drawn through between the auxiliary roller 20 and the guide roller 30, i.e. the free end of the tape 200 passes through an upper edge of the auxiliary roller 20 and a lower edge of the guide roller 30. At that time, a free end of the isolation film 62 is departed from the adhesive surface of the tape body 61 and is drawn to pass through between the guide roller 30 and the driven roller 40, further to pass through between the driven roller 40 and the guide portion 133, and finally to run out of the slot 118.

Figure 5:
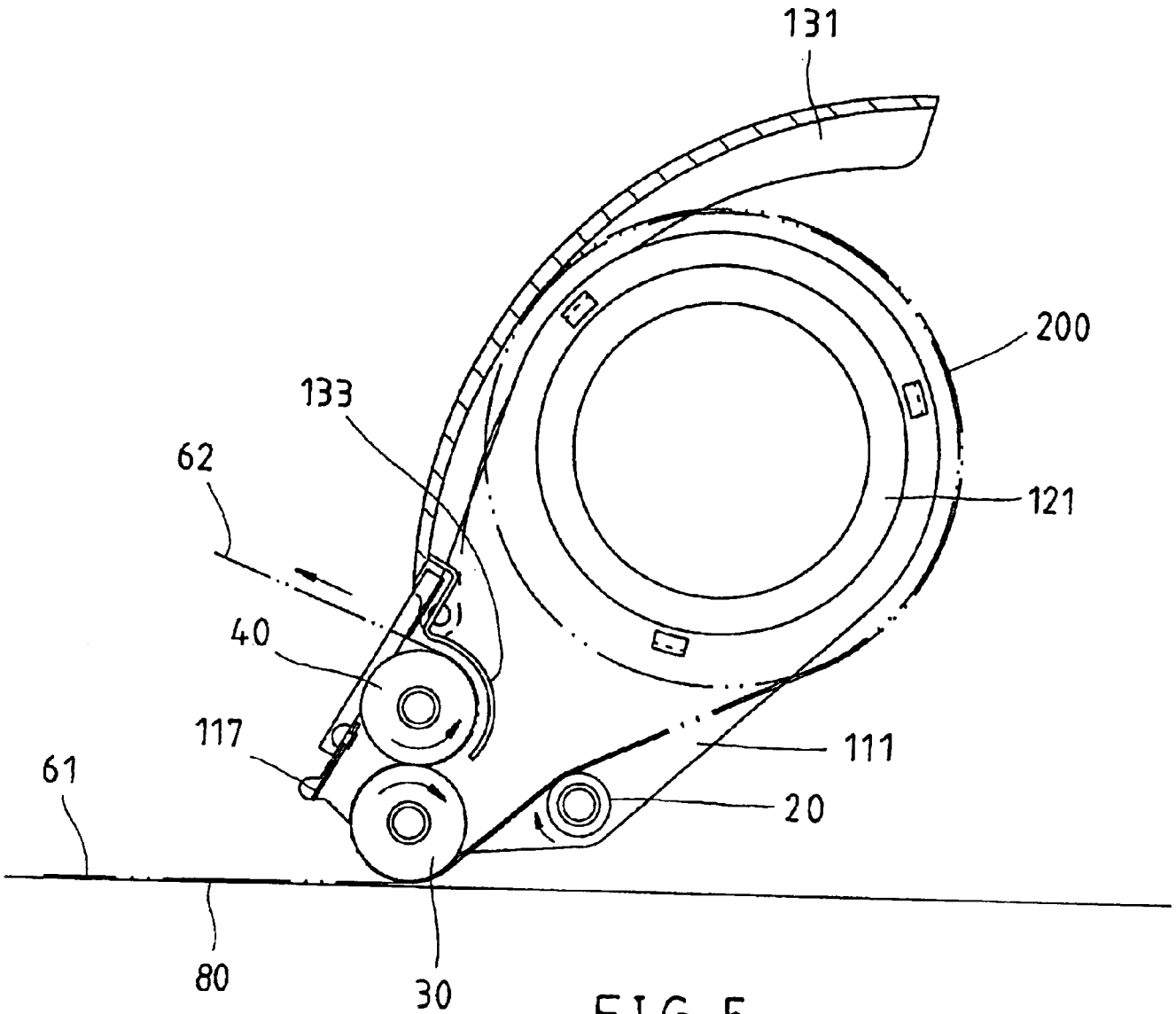
FIG. 5 is a sectional view of the preferred embodiment of the present invention dispensing the tape roll.
Figure 6:
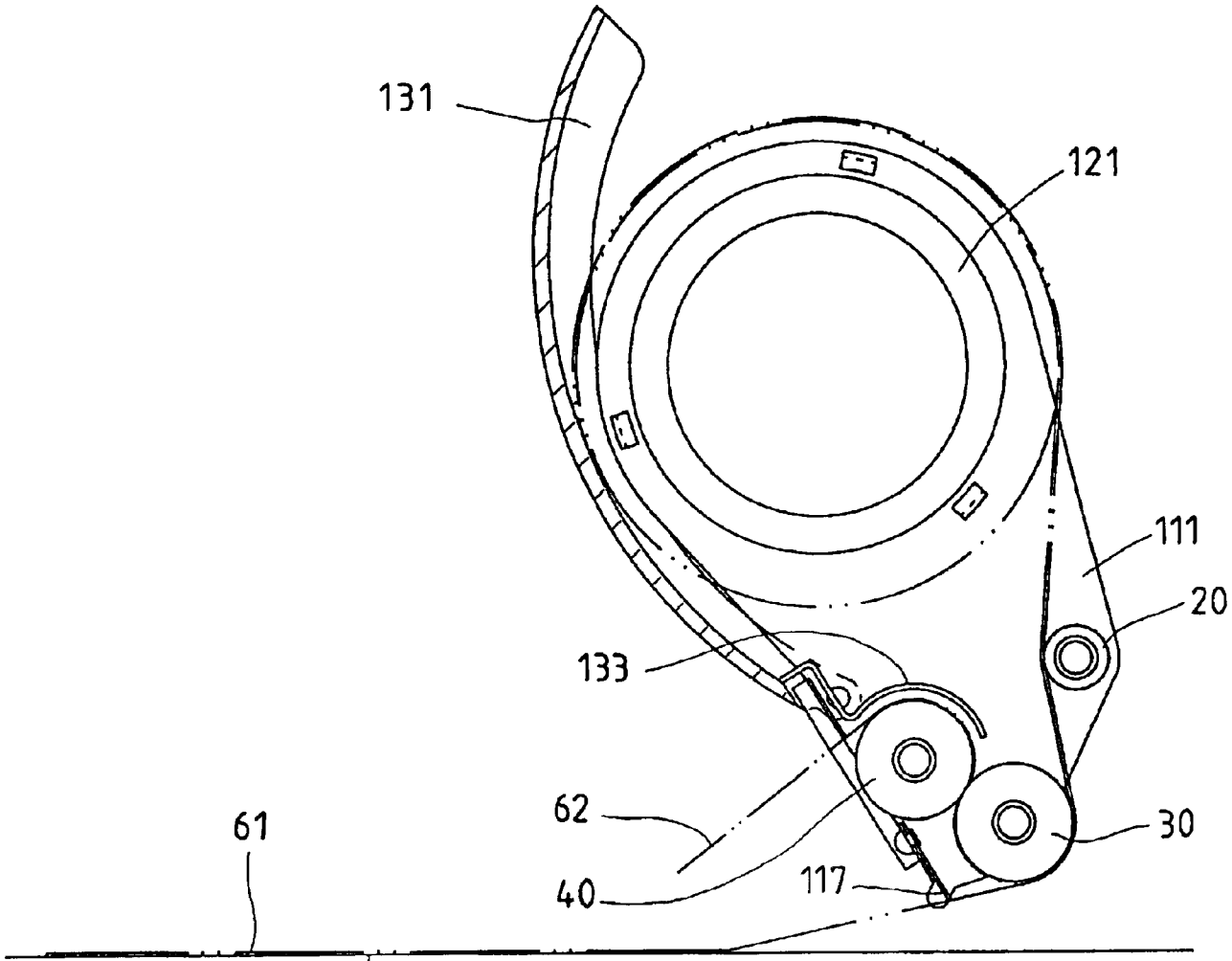
FIG. 6 is a sectional view of the preferred embodiment of the present invention cutting the tape roll.

When the user intends to dispense the tape 200 onto a workpiece 80, firstly, allow the guide roller 30 to press the free end of the tape body 61 onto the workpiece 80, and then pull the dispenser 100 backwards, as shown in FIG. 5. Meanwhile, the guide roller 30 is rotated by means of the friction generated between the workpiece 80 and the guide roller 30 to draw the tape body 61 to be continuously dispensed onto the workpiece 80. When the guide roller 30 is rotated, the driven roller 40 is driven to rotate conversely to enable the isolation film 62 between the guide roller 30 and the driven roller 40 to continuously move along the guide portion 133 and to run out of the slot 118 to further cause the tape body 61 adhered onto the workpiece 80 to be completely departed from the isolation film 62. When the tape body 61 is extended for a predetermined length, cut the tape body 61 by the cutter 117, as shown in FIG. 6, such that the tape body 61 is extended and adhered on the workpiece 80 and the isolation film 62 is simultaneously removed from the extended part of the tape body 61.

What is claimed is:

1. A double-sided adhesive tape dispenser comprising:

a main frame for mounting rotatably an adhesive tape roll thereon;

a guide roller rotatably mounted on said main frame;

a driven roller rotatably mounted on said main frame and positioned parallel to said guide roller, said driven roller having an outer surface engaging against that of said guide roller to be driven by said guide roller to roll; and said main frame comprises a crane and a reel, said main frame having a first frame member, a second frame member, and a cutter, said first frame member having a circular hole formed at a rear section of said first frame member and a plurality of clamp holes formed around said circular hole, said second frame member having two top plates and a guard plate, said two top plates being spaced apart and parallel to each other, each of said two top plates being perpendicularly connected with a front top edge of said first frame member at an end thereof to enable said guard plate to be parallel to said first frame member, said cutter being fixed to said top plate abutting a front end of said first frame member, said cutter having a blade portion facing outwards, said reel having a reel body and a retaining ridge, said reel body being inserted through said circular hole for mounting said tape roll, said retaining ridge extending transversely outwards from an edge of an end said reel body, said retaining ridge having a plurality of ear portions corresponding to said clamp holes, said retaining ridge engaging said first frame member and said ear portions engaging said clamp holes to secure said reel and said crane together.

2. The tape dispenser as defined in claim 1, wherein said crane comprises a slot defined among said two plates, said guard plate, and said first frame member for expelling an isolation film of said tape roll.

3. The tape dispenser as defined in claim 1, wherein said main frame comprises a handle having a gripping portion and a guide portion, said gripping portion being an arched rectangular plate and having pivot holes at an end thereof for being pivotably connected with said crane to enable said gripping portion to pivot at an angle relatively to said crane, said guide portion being an arched rectangular sheet connected with the end of said gripping portion having said pivot holes, said guide portion being in contrary shape to said gripping portion.

4. The tape dispenser as defined in claim 1, wherein said a guide roller comprises a first internal roller and a first external roller, said first internal roller being received in said first external roller and being rotatably mounted on said main frame by a rivet, said first external roller having a plurality of concavoconvex indentures formed on an outer surface thereof in a predetermined pattern.

5. The tape dispenser as defined in claim 1, wherein said driven roller comprises a second internal roller and a second external roller, said second internal roller being received in said second external roller and being rotatably mounted an said main frame by a rivet, said driven roller being position above said guide roller.

6. The tape dispenser as defined in claim 1, further comprising an auxiliary roller pivotably mounted on said main frame, said auxiliary roller being parallel to said guide roller and said driven roller and positioned below said guide roller for holding the tape dispensed from said tape roll.

* * * * *